United States Patent [19]

Fujita et al.

[11] 4,344,204

[45] Aug. 17, 1982

[54] APPARATUS FOR CLEANING DOOR FRAMES OF COKE OVENS

[75] Inventors: Kenji Fujita; Kazuo Korehisa; Hirosi Asaba; Hideo Harada, all of Yokosuka; Tsuneo Shibuya, Yokohama, all of Japan

[73] Assignee: Sumitomo Heavy Industries, Ltd., Tokyo, Japan

[21] Appl. No.: 184,307

[22] Filed: Sep. 5, 1980

[30] Foreign Application Priority Data

Sep. 7, 1979 [JP] Japan ..... 54-114884

[51] Int. Cl.[3] ..... C10B 43/04

[52] U.S. Cl. ..... 15/93 A; 202/241

[58] Field of Search ..... 15/93 A; 202/241

[56] References Cited

U.S. PATENT DOCUMENTS

| | | | |
|---|---|---|---|
| 3,398,416 | 8/1968 | Spindeler | 15/93 A |
| 3,696,004 | 10/1972 | McCullough | 15/93 A X |
| 3,955,232 | 5/1976 | Konno | 15/93 A |
| 4,000,043 | 12/1976 | Irwin | 15/93 A X |

*Primary Examiner*—Edward L. Roberts
*Attorney, Agent, or Firm*—Armstrong, Nikaido, Marmelstein & Kubovcik

[57] ABSTRACT

A door frame cleaner for coke ovens in which a supporting frame is mounted on a main frame, which is movable toward or away from a door frame, in such a way that the supporting frame can be moved laterally relative to the main frame in parallel therewith; a vertically reciprocable frame is mounted on the supporting frame at the front side thereof remote from the main frame; at least one pair of L-shaped levers are horizontally pivotably mounted on the vertically reciprocable frame; a front surface scraper is mounted on an outwardly extended arm of each L-shaped lever while an inner surface scraper, on the forwardly extended arm thereof; and a bias spring is so loaded that the forwardly extended arms of the L-shaped levers are normally moved toward each other, whereby even when there exist some misalignments between the scrapers on the one hand and the door frame on the other hand as the main frame is advanced, the supporting frame is so moved that the scrapers are automatically aligned with the door frame and when the front surface scrapers are engaged with their corresponding surfaces as the main frame is further advanced, the L-shaped levers are swung outwardly against the bias spring so that the inner scrapers are caused to press against their corresponding surfaces.

5 Claims, 7 Drawing Figures

APPARATUS FOR CLEANING DOOR FRAMES OF COKE OVENS

BACKGROUND OF THE INVENTION

The present invention relates to an apparatus for cleaning a door frame of a coke oven.

There has been devised and used a door frame cleaner of the type in which an intermediate frame with scrapers for cleaning the front surfaces of the door frame is vertically movably mounted on the front side of a supporting frame and carries a pair of frames which mount scrapers for cleaning the inner surfaces of the door frame and are laterally outwardly movable with actuators.

The door frame cleaner of the type described is very complex in construction because both the intermediate frame and the laterally movable frames must be provided. In addition, it becomes very expensive because the actuators must be provided for pressing the scrapers mounted on the movable frames against the inner side surfaces to be cleaned or retracting them to the inoperative positions.

The door frame cleaner of the type described is arranged in such a way that when a door lifter carrys the supporting frame to cause the inner side surface scrapers to be pressed against their corresponding surfaces, the supporting frame can be moved laterally so as to be brought into alignment with the door frame. However, the alignment can be made only after the scrapers have been inserted into the door frame. In other words, the supporting frame cannot align with the door frame during the course in which the scrapers are being inserted into the door frame and thus some alignment operation of the supporting frame must be conducted before inserting the scrapers into the door frame. As a consequence, the prior art door frame cleaner has not been able to carry out the door frame cleaning operations at high efficiency.

SUMMARY OF THE INVENTION

The present invention was made to overcome the above and other problems encountered in the prior art door frame cleaners and has for its object to provide a door frame cleaner which can attain automatic alignment with the door frame when the scrapers are inserted into the door frame and in which as the front surface scrapers are pressed against their corresponding surfaces of the door frame, the inner surface scrapers are naturally pressed against their corresponding surfaces to be cleaned, whereby the door frame cleaning operations can be carried out at high efficiency.

Another object of the present invention is to provide a door frame cleaner of the type described above which is simple in construction and easy to manufacture at less costs.

The above and other objects, effects and features of the present invention will become more apparent from the following description of a preferred embodiment thereof taken in conjunction with the accompanying drawings.

DESCRIPTION OF THE PREFERRED EMBODIMENT

Figure 1:
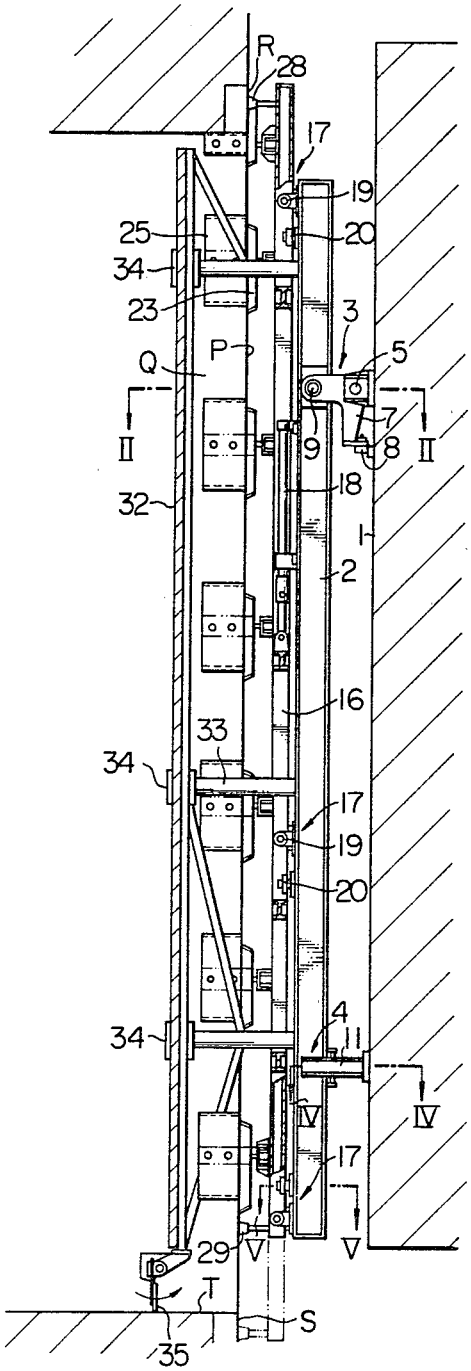
FIG. 1 is a side view of a preferred embodiment of a door frame cleaner in accordance with the present invention.

Referring to FIG. 1, a main frame 1 is mounted on the frame of a coke oven handling device such as a coke guide in such a way that the frame 1 can be moved toward or away from a door frame. A vertical supporting frame 2 is mounted on the front surface of the main frame 1 with an upper supporting mechanism 3 and a lower supporting mechanism 4 in such a way that the supporting frame 2 can be moved laterally while holding parallel relationship with the front surface of the frame 1.

Figure 3:
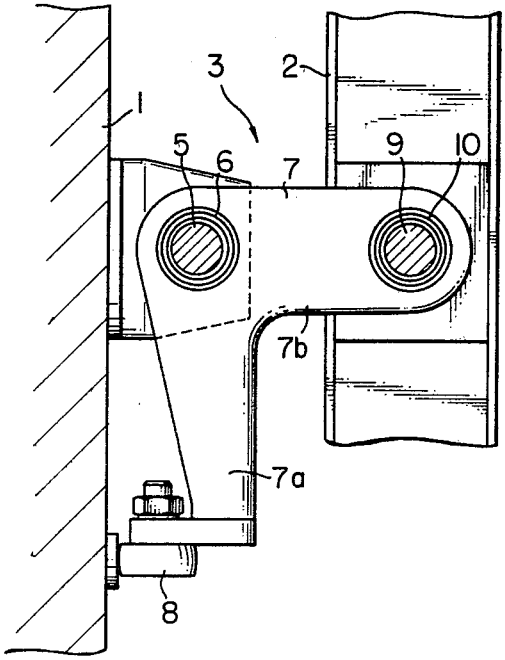
FIG. 3 is a side view, on enlarged scale, of an upper supporting mechanism for suspending a supporting frame from a frame.
Figure 2:
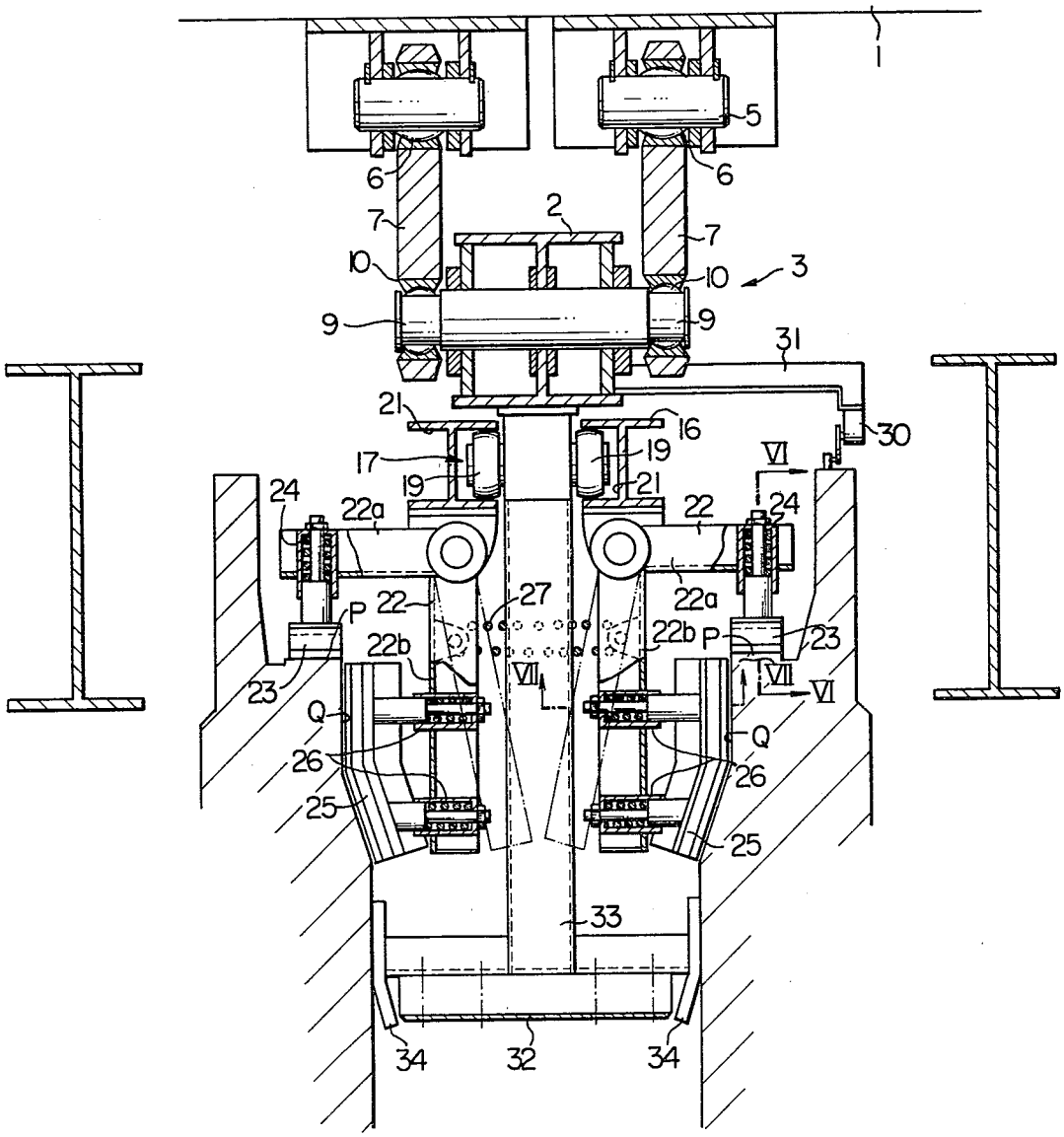
FIG. 2 is a cross sectional view, on enlarged scale, taken along the line II—II of FIG. 1.

As shown in FIGS. 2 and 3, the supporting frame 2 is supported by a pair of L-shaped levers 7 of the upper supporting mechanism 3 which in turn are supported by brackets anchored to the front surface of the main frame 1. More specifically, each L-shaped lever 7 is pivoted with a pin 5 and a spherical bearing 6 to the bracket and one arm 7*b* of the lever 7 is pivoted with a pin 9 and a spherical bearing 10 to the supporting frame 2. A horizontal roller 8 is rotatably attached to the lower end of the other arm 7*a* of the lever 7 in such a way that when the roller 8 bears against the front surface of the main frame 1, said one arm 7*b* of the lever can be maintained horizontally as best shown in FIG. 3. With the upper supporting mechanism 3 of the type described above, it is obvious that the supporting frame 2 can move laterally while holding the parallel relationship with the front surface of the frame 1.

Figure 4:
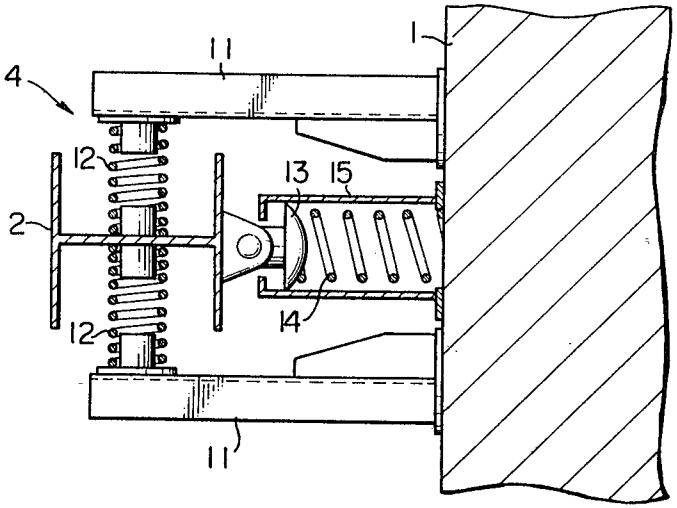
FIG. 4 is a cross sectional view, on enlarged scale, taken along the line IV—IV of FIG. 1 and used for the explanation of a lower supporting mechanism for the supporting frame.

The lower supporting mechanism 4 is shown in detail in FIG. 4. The supporting frame 2 is elastically supported by a pair of springs 12 loaded between the web of the supporting frame 2 and the free ends of parallel supporting arms 11 extended from the front surface of the main frame 1. A cylindrical spring casing 15 is extended from the front surface of the main frame 1 and houses a spring 14 and a spring seat 13 with a round head. The stem of the spring seat 13 is pivoted to a horizontal bracket extended from the rear flange of the supporting frame 2. The base of the round head of the spring seat 13 engages with the counter flange of the spring casing 15 at the open end thereof when the supporting frame 2 is caused to move away from the frame 1 so that the spring seat 13 cannot be pulled out of the casing 15 and the stroke toward the left of the supporting frame 2 is limited. The supporting frame 2 can move to the right toward the frame 1 against the spring 14.

Figure 5:
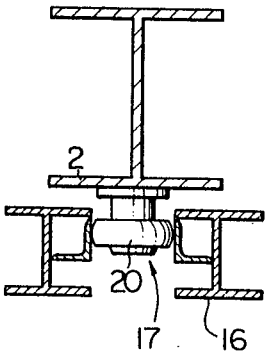
FIG. 5 is a cross sectional view, on enlarged scale, taken along the line V—V of FIG. 1.

Referring to FIGS. 1, 2 and 5, disposed in front of the front flange of the supporting frame 2 is a vertically movable frame 16 consisting of a pair of H-beams which are vertically extended in such a way that their webs are in parallel with each other and whose upper and lower ends are securely joined to each other so that they can move in unison. The movable frame 16 is guided by a plurality of guide mechanisms 17 which in turn are vertically spaced apart from each other by a suitable distance. An actuator 18 is provided to cause the vertical reciprocal movement of the movable frame 16.

As shown in FIGS. 2 and 5, each guide mechanism consists of a pair of guide rollers 19 which are fitted into the spaces 21 between the flanges of the H-beams (See FIG. 2), thereby guiding the movable frame 16 against the forward and backward movements and a guide roller 20 (See FIG. 5) fitted between the angles joined to the H-beams, thereby guiding the movable frame 16 against the lateral movements. These guide rolls 19 and 20 are rotatably mounted on the front flange of the supporting frame 2.

Figure 6:
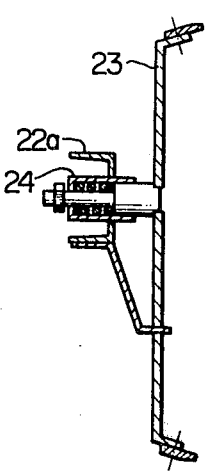
FIG. 6 is a cross sectional view taken along the line VI—VI of FIG. 2.
Figure 7:
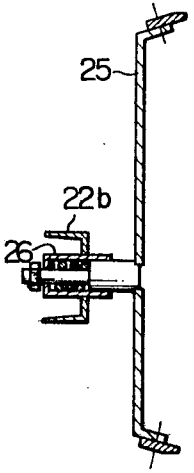
FIG. 7 is a cross sectional view taken along the line VII—VII of FIG. 2.

Referring back to FIG. 2, a plurality of L-shaped lever pairs 22 are horizontally pivotably mounted on the front flanges of the H-beams and vertically spaced apart from each other by a suitable distance (See FIG. 1). Each lever 22 has a forwardly extended arm **22*b* and an outwardly extended arm 22*a*. A scraper 23 for cleaning the front surface P of the door frame is carried by the outwardly extended arm 22*a* with an elastic supporting means 24 (See FIG. 6) while a scraper 25 for scraping the inner surface Q of the door frame is mounted on the forwardly extended arm 22*b* through elastic supporting means 26 (See FIG. 7). These elastic supporting means 24 and 26 are so designed and constructed as to force the scrapers 23 and 25 against the front and inner surfaces P and Q, respectively. Preferably a roller (not shown) may be supported on the outwardly extended arm 22*a* of each L-shaped lever 22 so as to be in engagement with the front surface P of the door frame when the scraper 23** is pressed against the front surface P.

The forwardly extended arms **22*b* of each lever pair 22 are normally moved toward each other under the force of a bias spring 27 as indicated by the broken lines in FIG. 2 so that the scrapers 25 for cleaning the inner surfaces Q can be easily inserted into the oven chamber. Alternatively, a bias spring may be loaded between the outwardly extended arm 22*a* and the movable frame 16**.

Referring back to FIG. 1, a scraper 28 for cleaning the upper front surface R is mounted on the movable frame 16 adjacent to its upper end while a scraper 29 for cleaning the lower front surface S is mounted on the movable frame 16 adjacent to its lower end.

Referring back to FIG. 2, a limit switch 30 is mounted at the free end of a supporting arm 31 extended from the supporting frame 2 so that when the limit switch 30 engages with the door frame, the forward movement of the main frame 1 can be stopped. A heat-shielding plate 32 is carried by supporting members 33 extended from the supporting frame 2 through the movable frame 16 beyond the scrapers 25 so that the latter can be protected against flames and thermal radiation from the oven chamber. Plural pairs of guides 34 are mounted on the supporting frames 33 in vertically spaced relationship with one another in such a way that the guides in each pair are positioned on both sides of the heat shielding plate 32, whereby the insertion of the scrapers 23 and 25 into the door frame may be facilitated.

Referring back to FIG. 1, a scraper 35 for cleaning the bottom surface T of the door frame is pivotably mounted on the heat shielding plate 32 at its lower end in such a way that it is not permitted to swing forwardly from its vertical position but it is permitted to swing backwardly as indicated by the arrow.

Next the mode of operation of the door frame cleaner with the above-described construction will be described. As the main frame 1 is moved forward, the guides 34 are inserted into the oven chamber and made into contact with the side walls thereof so that even when the frame 1 and the door frame are not in alignment with each other, the supporting frame 2 is moved laterally in parallel with the main frame 1 as described previously, whereby the alignment can be automatically attained. As the main frame 1 is further advanced, the scrapers 25, which are normally laterally inwardly biased to each other, are smoothly and positively inserted into the door frame. As the front surface scrapers 23 are made into engagement with the front surfaces P, the forwardly extended arms **22*b* of the L-shaped lever pair 22 are forced to swing outwardly against the bias spring 27 as indicated by the solid lines in FIG. 2 so that the scrapers 25 are pressed against the inner surfaces Q. In addition, the elastic supporting means 24 and 26 further force the scrapers 23 and 25 against the front and inner surfaces P and Q. The limit switch 30 is so arranged that it is closed when the scrapers 23 and 25 are pressed against the front and inner surfaces P and Q in the manner described above. Then, the actuator 18 is energized to vertically reciprocate the movable frame 16 (See FIG. 1) and hence the scrapers 23 and 25 so that the latter can scrape the deposits off from the surfaces P and Q. The upper and lower scrapers 28 and 29 are also vertically reciprocated in unison with the movable frame 16 so that they scrape the deposits off from the upper and lower front surfaces R and T. The deposits on the bottom surface T (See FIG. 1) are removed by the scraper 35, which is locked at the vertical operative position, when the frame 1** is retracted away from the door frame.

Obviously, it is preferable to use the guides 34 when the scrapers are advanced into the door frame, but they may be eliminated because even without them the scrapers 25 can be easily inserted into the door frame and the alignment can be attained automatically when the scrapers 23 and 25 are pressed against the corresponding surfaces P and Q.

In summary, according to the present invention, the automatic alignment can be attained when the scrapers are inserted into the door frame and the insertion can be effected in positive and simple manner. In addition the front surface scrapers 23 and the inner surface scrapers 25 can be pressed against the corresponding surfaces of the door frame by merely forcing the frame 1 forwardly and thereafter the cleaning of the door frame is effected by moving up and down the movable frame 16. As a consequence, the door frame cleaning operations can be carried out at high efficiency. Moreover, the scraper applying mechanism according to the invention is more simplified as compared with the prior art door frame cleaner in which the inner surface scrapers must be engaged with the corresponding surfaces of the door frame with associated actuators separately from the front surface scrapers. Therefore, the door cleaner in accordance with the present invention is very simple in overall construction and very easy to manufacture at less cost.

What is claimed is:

1. An apparatus for cleaning door frames of a coke oven comprising:

a main frame movable toward or away from a door frame;

a supporting frame so disposed in front of said main frame that said supporting frame is movable laterally relative to said main frame in parallel therewith;

a movable frame so disposed in front of said supporting frame that said movable frame is vertically reciprocable relative to said supporting frame;

at least one pair of L-shaped levers horizontally pivotably mounted on said movable frame, the pivotal points of said L-shaped levers being horizontally laterally spaced apart from each other by a suitable distance, each L-shaped lever having a forwardly extended arm and a laterally outwardly extended arm;

a front surface scraper mounted on said laterally outwardly extended arm;

an inner surface scraper mounted on said forwardly extended arm; and a bias means so loaded that said forwardly extended arms of said pair of L-shaped levers are normally moved toward each other.

2. An apparatus as set forth in claim 1 wherein said supporting frame is suspended pivotally from one ends of a pair of levers which are pivoted at their other ends to said main frame in such a way that they are swingable horizontally.

3. An apparatus as set forth in claim 1 or 2 wherein said supporting frame is connected to at its lower end to said main frame through a laterally biasing means and a forwardly biasing means.

4. An apparatus as set forth in claim 1 wherein at least one supporting member is extended horizontally from said supporting frame beyond said inner surface scrapers carried by said L-shaped levers; and a heat shielding plate is supported by said supporting member at its front end, whereby when said inner surface scrapers are pressed against their corresponding surfaces of the door frame, said heat shielding plate can substantially close the opening of an oven chamber.

5. An apparatus as set forth in claim 4 wherein a pair of guides are mounted on said supporting member in such a way that said guides are positioned on both sides of said heat shielding plate, whereby when said inner surface scrapers are being advanced to be pressed against their corresponding surfaces, said guides are made into slidable contact with the inner side walls of said oven chamber.

* * * * *